343-700 MS AU 251 EX
11/10/87 XR 4,706,050

United States Patent [19]

Andrews

[11] Patent Number: 4,706,050

[45] Date of Patent: Nov. 10, 1987

[54] MICROSTRIP DEVICES

[75] Inventor: Frank P. Andrews, Easton, England

[73] Assignee: Smiths Industries Public Limited Company, London, England

[21] Appl. No.: 772,522

[22] Filed: Sep. 4, 1985

[30] Foreign Application Priority Data

Sep. 22, 1984 [GB] United Kingdom ..... 8424042
Mar. 15, 1985 [GB] United Kingdom ..... 8506715

[51] Int. Cl.[4] ..... H01P 1/203; H01P 7/08; H01Q 1/38

[52] U.S. Cl. ..... 333/205; 333/204; 333/219; 333/235; 333/246; 343/700 MS; 343/873; 29/600

[58] Field of Search ..... 343/700 MS, 872, 873, 343/907, 908; 333/185, 202, 203, 204–205, 246, 236, 156, 161, 219, 222, 223, 238, 235; 29/600, 601

[56] References Cited

U.S. PATENT DOCUMENTS

| | | | |
|---|---|---|---|
| 2,915,716 | 12/1959 | Hattersley | 333/204 |
| 3,350,498 | 10/1967 | Leeds | 333/238 |
| 4,010,475 | 3/1977 | James | 343/834 |
| 4,063,245 | 12/1977 | James et al. | 343/700 MS |
| 4,063,246 | 12/1977 | Greiser | 343/700 MS |
| 4,187,480 | 2/1980 | Frazita | 333/161 |
| 4,638,271 | 1/1987 | Jecko et al. | 333/205 |

FOREIGN PATENT DOCUMENTS

| | | | |
|---|---|---|---|
| 0013981 | 2/1979 | Japan | 333/238 |

*Primary Examiner*—Marvin L. Nussbaum
*Attorney, Agent, or Firm*—Pollock, VandeSande and Priddy

[57] ABSTRACT

A microstrip antenna or other microstrip device has a planar electrically-conductive region on the surface of a dielectric board. The device is tuned by silk-screen printing one or more layers of a dielectric ink/paint over the surface of the device. This produces layers of a predetermined thickness which each reduce the frequency of tuning of the device by a predetermined amount until the desired frequency is achieved.

6 Claims, 4 Drawing Figures

MICROSTRIP DEVICES

BACKGROUND OF THE INVENTION

This invention relates to microstrip devices such as antennas, or filters, and to methods of tuning and manufacturing such devices.

Microstrip antennas and other devices need to be tuned because the dielectric of the material on which the printed element is supported is variable from batch to batch, and any changes in dielectric constant will affect the tuning. Tuning of the microstrip is carried out by either trimming matching stubs connected to the feeding cable by which energy is supplied to the device, or by modification of the printed pattern itself.

In one technique, the dielectric constant of the material is tested prior to manufacture and, according to this, an appropriate pattern for the printed element is selected. Because the element is generally formed by a photo-etching process, this requires a large number of different etching masks so that the appropriate mask can be selected to suit the value of the dielectric constant of the material. This procedure is complicated and expensive, and does not lend itself to large scale production.

An alternative technique involves the removal of areas of the printed pattern, after manufacture, until correct tuning is achieved. Again this technique is time-consuming and expensive; it is also difficult to control and requires skilled technicians to carry out.

Microstrip filters can be used to filter microwave energy supplied to a microstrip antenna so that the characteristics of the energy propagated by the antenna can be precisely controlled. Such filters take the form of a capacitor/inductance circuit and may form a part of the same board on which the antenna is formed. As with antennas themselves, the filter must be tuned accurately to produce efficient performance and this presents the same problems when the above-mentioned tuning techniques are used.

BRIEF SUMMARY OF THE INVENTION

It is an object of the present invention to provide a method of tuning and manufacturing a microstrip device, and a device so tuned or manufactured, which avoids, to a substantial extent, the above-mentioned problems.

According to one aspect of the present invention there is provided a method of tuning a microstrip device of the kind having a planar electrically-conductive region on the surface of a dielectric substrate, the frequency of tuning of the device being measured, and a part at least of the surface of the device being coated with a predetermined number of layers of dielectric material of predetermined thickness so as to reduce the frequency of tuning to a desired value.

According to another aspect of the present invention there is provided a method of tuning a microstrip antenna of the kind having a planar electrically-conductive region on the surface of a dielectric substrate, the frequency of tuning of the antenna being measured, and a part at least of the surface of the antenna being coated with a predetermined number of layers of dielectric material of predetermined thickness so as to reduce the frequency of tuning to a desired value.

According to a further aspect of the present invention there is provided a method of tuning a microstrip filter of the kind having a planar electrically-conductive region on the surface of a dielectric substrate, the frequency of tuning of the filter being measured, and a part at least of the surface of the filter being coated with a predetermined number of layers of dielectric material of predetermined thickness so as to reduce the frequency of tuning to a desired value.

According to yet another aspect of the present invention there is provided a method of manufacture of a microstrip device including the steps of forming a planar electrically-conductive region on the surface of a dielectric substrate, the frequency of tuning of the device being measured and a part at least of the surface of the device being coated with a predetermined number of layers of dielectric material of predetermined thickness so as to reduce the frequency of tuning to a desired value.

A plurality of layers may be coated on the surface, and the dielectric material may be a paint or ink. The or each layer is preferably applied to the surface by a silk-screen process, and the or each layer may be applied to substantially the entire surface.

According to an additional aspect of the present invention there is provided a microstrip device tuned or made by a method according to any of the above aspects of the present invention.

According to another aspect of the present invention there is provided a microstrip device having a planar electrically-conductive region on the surface of a dielectric substrate and a predetermined number of layers of dielectric material of predetermined thickness on a part at least of the surface of the device, the number of said layers being selected to reduce the frequency of tuning of the device to a desired value.

According to another aspect of the present invention there is provided a microstrip antenna having a planar electrically-conductive region on the surface of a dielectric substrate and a predetermined number of layers of dielectric material of predetermined thickness on a part at least of the surface of the antenna, the number of said layers being selected to reduce the frequency of tuning of the antenna to a desired value.

According to another aspect of the present invention there is provided a microstrip filter having a planar electrically-conductive region on the surface of a dielectric substrate and a predetermined number of layers of dielectric material of predetermined thickness on a part at least of the surface of the filter, the number of said layers being selected to reduce the frequency of tuning of the filter to a desired value.

A planar microstrip antenna and filter for an aircraft radar altimeter system and a method of tuning and manufacturing such an antenna and filter, according to the present invention, will now be described, by way of example, with reference to accompanying drawings.

DETAILED DESCRIPTION

Figure 1:
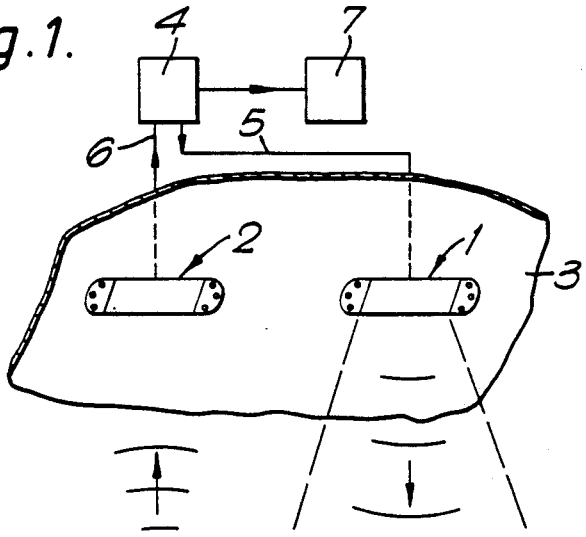
FIG. 1 shows the antenna and the altimeter system schematically.

With reference to FIG. 1, there is shown an aircraft radar altimeter system including a transmitting antenna assembly 1 and an identical receiving antenna assembly 2 bolted to the underside of the aircraft fuselage 3. A transmitter/receiver unit 4, mounted in the aircraft, supplies microwave signals along the line 5 to the transmitting antenna assembly 1, and receives, on line 6 signals from the other antenna assembly 2 in accordance with the microwave energy reflected to the receiving assembly from the ground beneath the aircraft. By measurement, in the usual way, of the time interval between transmitted and received signals, the unit 4 calculates the height of the aircraft above ground and supplies suitable signals to an altimeter indicator 7 in the aircraft cockpit.

Figure 2:
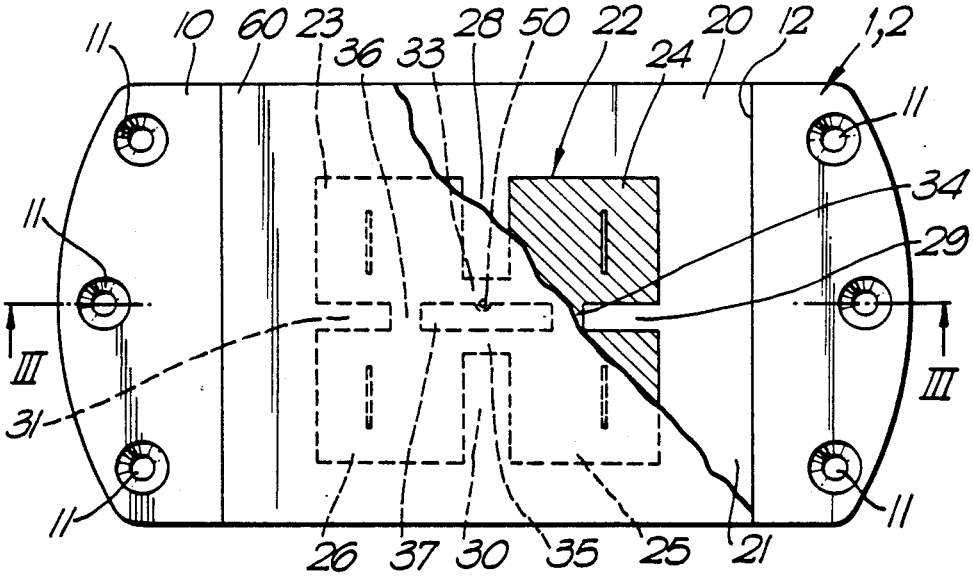
FIG. 2 is a partly cut-away plan view of the front surface of the antenna.
Figure 3:
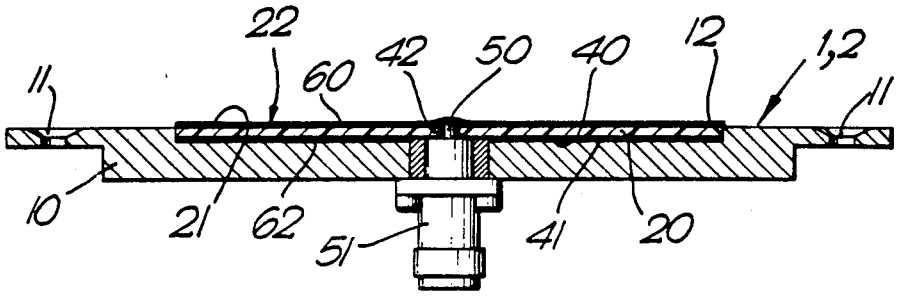
FIG. 3 is a cross-sectional elevation through the antenna along the line III—III of FIG. 2.

The transmitting and receiving assemblies 1 and 2 will now be described in greater detail with reference to FIGS. 2 and 3. The assemblies 1 and 2 each have a rigid aluminum backing plate 10 of generally rectangular shape, with rounded ends. The plate 10 is 148 mm long by 77 mm wide and is provided with countersunk holes 11 at its ends for use in mounting the assembly. The plate is about 9 mm thick over most of its length, the central region being cut away on the front surface to form a central recess 12 about 90 mm long that is of reduced thickness. The region of the holes 11 is also of reduced thickness. The central recess 12 receives the antenna array board 20, the forward surface 21 of which is flush with the exposed surface at the ends of the backing plate 10.

The antenna array board 20 is of a fiberglass-loaded Teflon or other stripline or microstrip laminate and carries on its forward surface 21 a planar antenna array 22 formed by a coating of copper metal. The array 22 comprises four rectangular conductive, radiating pads 23 to 26 that are separated from one another by orthogonal slots 28 to 31. Narrow conductive tracks 33 to 36 link the pads 23 and 24, the pads 24 and 25, the pads 25 and 26, and the pads 26 and 23 respectively. Microwave energy is supplied to the pads 23 to 26 by a rectangular slot 37, located centrally, which extends a short distance between the pads 23 and 26, and the pads 24 and 25. The slot 37 also provides a matching element for the supply of energy to and from the pads.

The antenna array 22 is located approximately centrally within the board 20, being about 58 mm long by 50 mm wide.

The rear surface 40 of the board 20 is entirely covered by a copper layer 41. The board 20 is provided with a small central aperture 42 that is aligned with the upper edge of the central slot 37, midway along its length. Electrical connection to the array 22 is made at the upper edge of the central slot 37 by the central pin 50 of a coaxial connector 51 which is mounted on the rear of the backing plate 10. The pin 50 extends through the aperture 42 and is soldered to the copper track 33.

The entire front surface 21 of the board 20 is coated with one or more thin layers 60 of a dielectric ink or paint, the purpose of which is described in detail below.

The antenna array board 20 is made from a board that is coated on both sides with a layer of copper. The copper is removed (such as by photo-etching) from those regions which are to be nonconductive so as to produce the array 22 on the forward surface 21.

The array board 20 is secured to the backing plate 10 by a layer 62 of epoxy adhesive, and electrical connection is established to the array 22 by soldering the pin 50 of the connector 51 in position. The antenna 1 is then tested in a conventional way to measure the frequency of operation, which in this example is required to be 4300 MHz. Variations in the dielectric constant of the board 20, from one batch to another, cause corresponding variations in tuning. In accordance with the present invention, these variations are compensated by the one or more dielectric layers 60 of an ink, paint or similar material on the front surface 21 of the board 20. The terms 'ink' and 'paint' are used interchangeably in this specification.

The coating or coatings 60 are applied by a silk-screen process using a nylon screen such as sold by DEK Printing Machines Limited with a mesh count code of 110 HD. The coating material is an ink formed from three parts of white Polyscreen Base Ink with one part by weight of Polyscreen Matt Catalyst SP434, both supplied by Screen Process Supplies Limited. This may be thinned with Polyscreen Thinner/Cleaner and, if necessary, drying may be slowed using Polyscreen Retarder, both supplied by Sericol Group.

It has been found that one layer of such a coating applied in this way reduces the frequency by 20 MHz and that this reduction is readily reproducible. Thus, if prior to coating, the antenna is found to have a frequency of, for example about 4320 MHz, one layer is applied, whereas if the frequency is about 4360 MHz, three layers are applied. Where more than one layer is needed, each layer is semidried prior to application of the next layer. It will be appreciated, of course, that the shape and size of the array is initially selected so that it produces a frequency of tuning that is not less than the desired frequency.

The coating 60 is applied over the entire surface of the board 20 because the coating serves a protective purpose, as well as a tuning purpose. It would, however, be possible to achieve similar tuning by merely coating the central slot 37 since the tuning is produced predominantly by altering the matching of the slot with the array.

Although the antenna preferably includes a matching element, the coating process may be effective to tune other antennas by altering the effective area of the conductive pads.

The pattern of the antenna array need not be the same as that described above and the array need not be fed at a slot. In this respect, for example, the matching element may take the form of two parallel conductive tracks separated by a gap along their length. The application of a dielectric coating in this gap could be used to tune such an antenna.

Figure 4:
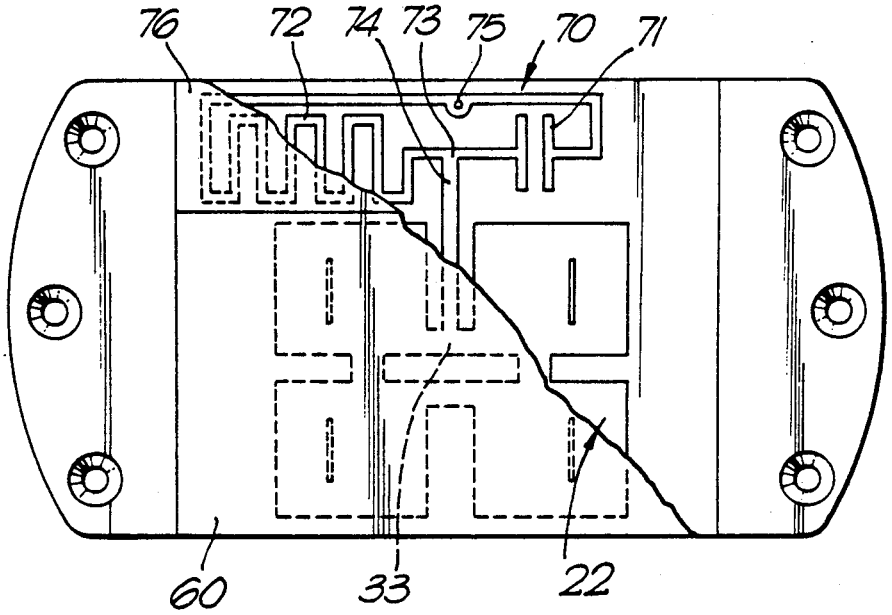
FIG. 4 is a plan view of an antenna and a filter.

With reference to FIG. 4, there is shown another microstrip device including an antenna array 22 of the kind described above and additionally a microstrip filter 70. The filter 70 comprises a parallel connection of a capacitor 71 and inductance 72. One of the junctions 73 between the capacitor 71 and inductance 72 is connected via a track 74 to the track 33 of the antenna array 22. Microwave energy is supplied to the device at the other junction 75 between the capacitor 71 and inductance 72, from the back of the device. Both the capacitor 71 and inductance 72 are formed by means of a copper layer in the form of tracks.

In operation, the filter 70 is selected so that only microwave energy having the desired frequencies is passed to and from the antenna. Fine tuning of the filter is carried out by means of successive coats of dielectric ink/paint 76 applied by silk-screen printing in a similar manner to the ink/paint used to tune the antenna itself. In general, the number of coats of ink/paint 76 required to tune the filter 70 will differ from the number of coats of ink/paint 60 required to tune the antenna.

In some applications the layer or layers of ink/paint by themselves may provide sufficient protection for the antenna, although in other applications the antenna may be covered by a radome after coating. It will be appreciated that the radome will affect tuning of the antenna by a predetermined amount; this is borne in mind when coating the antenna so that the desired frequency is produced after securing the radome.

Instead of silk-screen printing it may be possible to coat the antenna surface by other means, although silk-screen printing has been found to give a readily reproducible coating of predetermined thickness. Instead of applying several layers to achieve the desired tuning it may be possible to apply one layer of increased thickness.

It will be appreciated that the method could be used to manufacture and tune other microstrip devices.

What I claim is:

1. A method of tuning a microstrip device of the kind comprising a dielectric substrate and a planar electrically-conductive region on a surface of the substrate, wherein the frequency of tuning of the device is initially measured, and wherein a part at least of a surface of the device is thereafter coated by a silk-screen process with a plurality of layers of dielectric ink or paint, each of which layers has the same predetermined thickness, superimposed directly on top of one another so as thereby to increase the thickness of the dielectric coating in a plurality of equal steps thereby to reduce the frequency of tuning of the device progressively from its initially measured value to a desired final value.

2. The method of claim 1 wherein said microstrip device comprises an antenna array that is defined by a portion of said electrically concentric region, and a microstrip filter interconnected to said antenna array and defined by a further portion of said electrically conductive region, the number of said layers which are coated over the antenna array portion of said region being different from the number of said layers which are coated over the microstrip filter portion of said region.

3. A method of tuning a microstrip antenna of the kind comprising a dielectric substrate and a planar electrically-conductive region on a surface of the substrate, wherein the frequency of tuning of the antenna is initially measured, and wherein a part at least of a surface of the antenna is thereafter coated by a silk-screen process with a plurality of layers of dielectric ink or paint, each of the same predetermined thickness, superimposed directly on top of one another thereby to increase the thickness of the dielectric coating in steps so as to reduce the frequency of tuning of the antenna progressively from its initially measured value to a desired final value.

4. A method of tuning a microstrip filter of the kind comprising a dielectric substrate and a planar electrically-conductive region on a surface of the substrate, wherein the frequency of tuning of the filter is initially measured, and wherein a part at least of a surface of the filter is thereafter coated by a silk-screen process with a plurality of layers of dielectric ink or paint, each of the same predetermined thickness, superimposed directly on top of one another so as thereby to increase the thickness of the ink or paint coating in steps and thereby reduce the frequency of tuning of the filter progressively from its initially measured value to a desired final value.

5. A method of manufacture of a microstrip device comprising the steps of: providing a dielectric substrate having a surface thereon; forming on said surface a planar electrically-conductive region; measuring the frequency of tuning of the device so formed; and thereafter coating by a silk-screen process a part at least of a surface of the device with a plurality of layers of dielectric ink or paint, each of the same predetermined thickness, superimposed directly on top of one another so as thereby to increase the thickness of the coating in steps and thereby reduce the frequency of tuning of the device progressively from its previously measured value to a desired lesser value.

6. A method according to one of claims 1 through 5, wherein each said layer is applied to substantially the entire surface of the device.

* * * * *